United States Patent [19]

Cox et al.

[11] 4,079,874

[45] Mar. 21, 1978

[54] ROLL DISPENSER

[75] Inventors: Terence Alan Cox, Tamworth; John Jerram, Lichfield; Paul Steabben Hepworth, Oadby, all of England

[73] Assignee: Swish Products Limited, Tamworth, England

[21] Appl. No.: 767,118

[22] Filed: Feb. 9, 1977

[51] Int. Cl.[2] ..... B26F 3/02

[52] U.S. Cl. ..... 225/47; 225/52; 225/74

[58] Field of Search ..... 225/46, 47, 73, 74, 225/75, 52, 51; 242/55.2–55.53

[56] References Cited

U.S. PATENT DOCUMENTS

| | | | |
|---|---|---|---|
| Re. 21,678 | 12/1940 | Daykin | 225/46 |
| 452,719 | 5/1891 | Ross | 225/74 |
| 2,288,332 | 6/1942 | Steiner et al. | 225/46 X |
| 2,839,140 | 6/1958 | Vogt | 225/74 X |
| 3,040,943 | 6/1962 | Bump | 225/73 X |
| 3,104,043 | 9/1963 | Wyant | 225/74 X |
| 3,228,579 | 1/1966 | Dong et al. | 225/47 X |
| 3,232,505 | 2/1966 | Wyant | 225/74 X |

*Primary Examiner*—J. M. Meister
*Attorney, Agent, or Firm*—Norris & Bateman

[57] ABSTRACT

Dispenser for web material in roll form comprises a box or like container in which the roll is rotatably received, and which defines a web path which extends between first and second members, the first member being a severing member pivotally mounted for rocking movement about an axis transverse to said path and having a serrated or other tearing edge across an outer part of the path against which an outer end part of the web can be pulled at an angle for severance from the roll and a ridged or other clamping portion inwardly of said axis for cooperation with the second member so that when the web is pulled against said tearing edge an inner part of the web is automatically clamped against outward movement.

The dispenser is particularly useful for domestic paper towelling, plastics film or foil.

7 Claims, 4 Drawing Figures

ROLL DISPENSER

This invention relates to dispensers for web material in roll form; for example wrapping material, paper towelling, toilet rolls, tissue, metal foil, waxed paper, plastics film, or tear-off plastics bags. Such materials are now widely used in the home e.g. in the kitchen, toilet or bathroom; as well as in shops, offices and other trades.

It is known to provide a dispenser, for example in the form of a box, serving as a support or container for the roll and provided with a serrated or other tearing edge transversely of a path along which web is drawn from the roll, for example on a lid of a box. The web is pulled at an angle against this edge to sever an end part of it from the remainder. The type of dispenser is not always effective because said pulling action tends to cause further unwinding of the roll. If an attempt is made to counteract this by giving the roll higher resistance to unwinding it may be difficult to draw further material from the roll so causing unwanted tearing or damage due to excess tension. In both cases wastage of material will result and/or inconvenience in use, e.g. severance may only be achieved by a two-handed operation.

The object of the invention is to provide a dispenser which is of simple construction and therefore cheap to manufacture, yet which is effective in use with a range of types of web material.

The invention provides a dispenser characterised by supporting means in the form of a container for receiving the roll in use and defining a web path extending between first and second members, the first member being a severing member pivotally mounted for rocking movement about an axis transverse to said path and having its tearing edge across an outer part of the path remote from said axis and a clamping portion inwardly of said axis for co-operation with the second member whereby when the web is so pulled against said edge said clamping portion is urged into engagement with the second member to clamp an inner part of the web and resist movement of the latter along the path.

A preferred embodiment of the invention is now more particularly described with reference to the accompanying drawings wherein.

Figure 1:
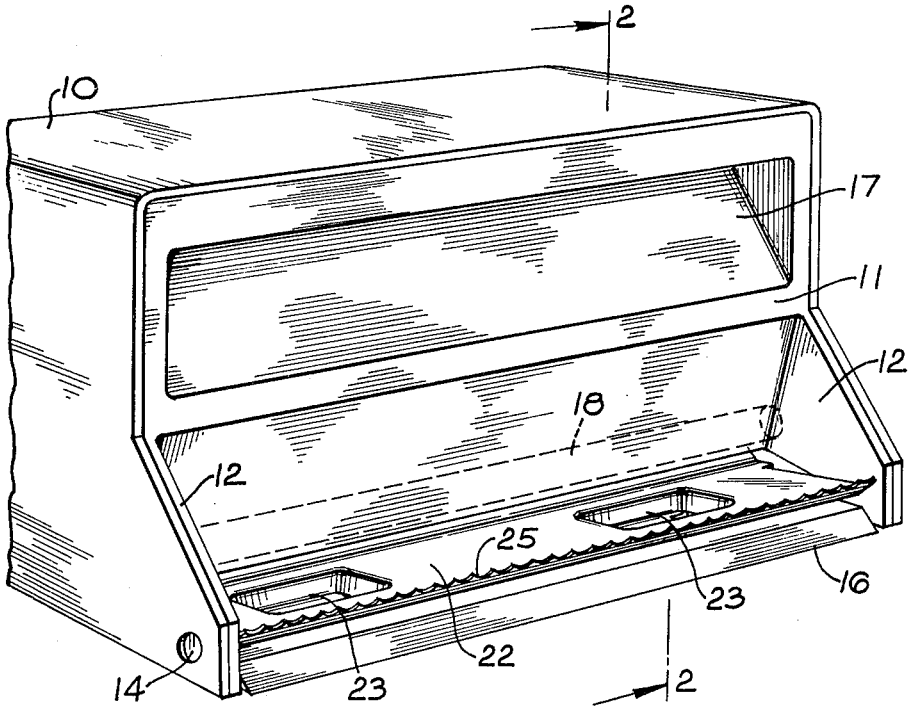
FIG. 1 is a perspective view of a roll dispenser.

The dispenser comprises roll support means in the form of a moulded plastics box 10 which can be stood on a table top, mounted on a wall, or attached to the undersurface of a shelf or worktop leaving its front accessible. The front is closed by a moulded plastics plastics door 11 having forwardly extending pivot arms 12 at each side of its lower portion provided with pivot formations 14 which are rotatably engaged in sockets of corresponding forward extensions of the box side walls enabling the door to be swung open forwardly and downwardly.

The floor 15 is carried forward between said extensions and terminates in a downwardly sloping lip 16 which serves as a stop to engage arms 12 of the door at the fully open position. A moulded recess 17 in an upper part of the door 11 serves as a handle to facilitate opening.

A transverse guide roller 18 is journalled between inwardly extending side flanges of door 11 so that when the door is closed roller 18 is within the lower front portion of the box with its periphery projecting into a gap defined between the lower edge of door 11 and floor 15.

Figure 4:
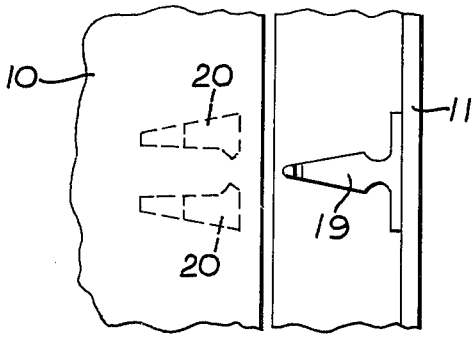
FIG. 4 is a detail of a door catch of the dispenser.

Door 11 is held closed by a catch (FIG. 4) comprising an integrally moulded male catch formation 19 in the form of an arrow head on an upper inner face of the handle recess defining part of the door; and a co-acting female catch formation integrally moulded on the interior of the top of box 10 comprising a pair of detent formations 20 on resilient arms. The latter are formed in a single moulding operation with the box body by means of a limb on a first die defining the body exterior, which limb is subsequently withdrawn through an aperture (not shown) left in the rear wall of the box, co-operating with parts of a second die used to form the box interior.

The back of box 10 merges with floor 15 in a radiused corner whose curvature is substantially that of a standard roll 21 of web material which the box is to accommodate, and floor 15 slopes forward somewhat so that roll 21 will rest in the box and will tend to move forward into peripheral contact with guide roller 18. An area of the back and floor of the box against which the periphery of roll 21 may abut is given a special broken surface finish to reduce friction and, in particular, any tendency of thin plastics film or foil to cling or stick so as to impede free rotation of roll 21.

A pressed metal clamping and cutting member 22 is located on the forward extension of floor 15 so that it can rock on a pair of downwardly directed fulcrum formations 23, each of which is provided with a tag 24 engaged in apertures in floor 15 to prevent upward or rearward displacement.

The front edge 25 of member 22 is bent upwards and is provided with a series of saw-teeth, preferably having a tooth depth of 1.5mm, and the gaps defined by the teeth being part-circular with a radius of 2.4 mm.

The rear part of member 22 is cranked upwardly and then downwardly to form a clamping ridge 26 immediately below roller 18. Member 22 is so balanced that it will normally tilt rearwardly to leave a space between ridge 26 and roller 18.

Figure 2:
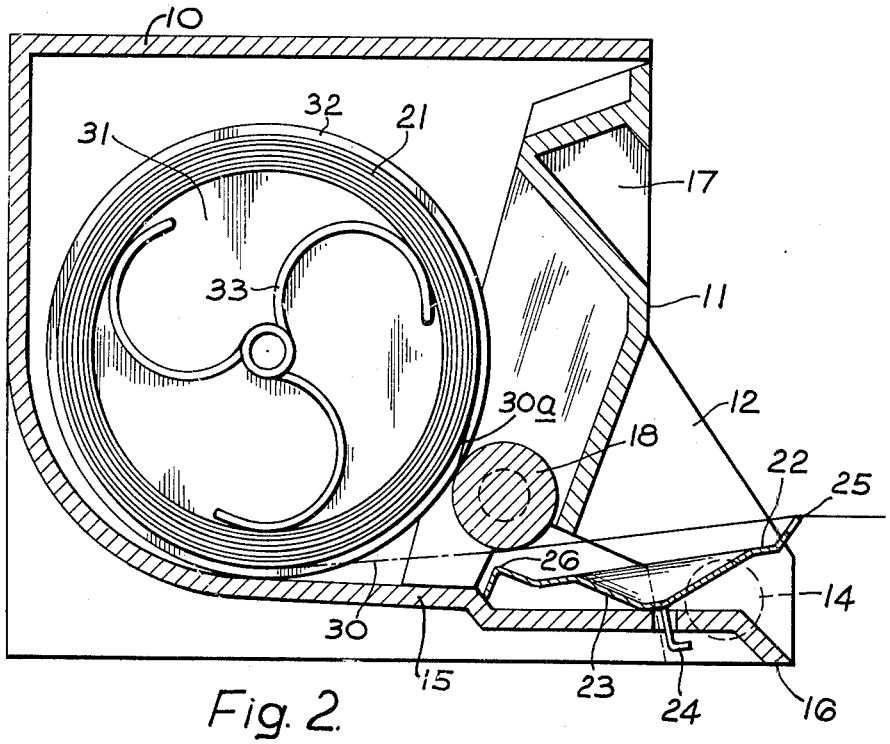
FIG. 2 is a cross-sectional view on line 2—2 of FIG. 1.
Figure 3:
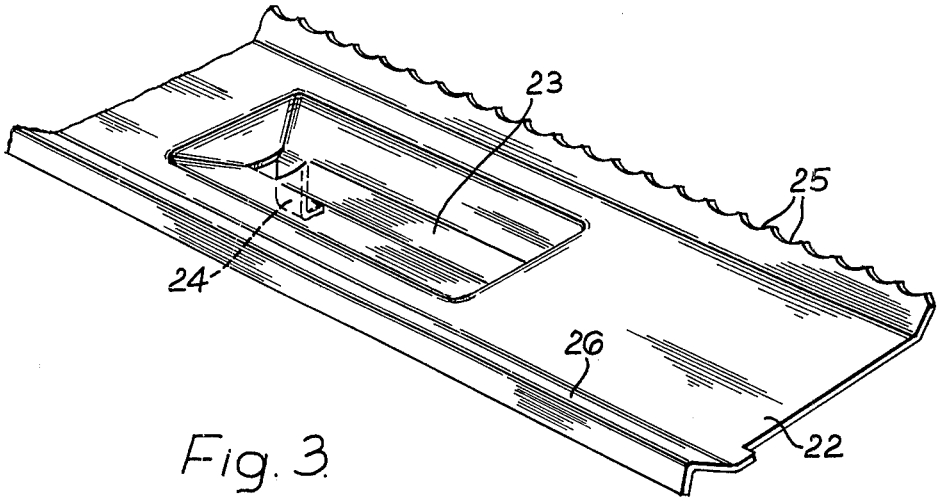
FIG. 3 is a detail of a cutting and clamping member of the dispenser.

In use, door 11 is opened, so swinging roller 18 forwardly and below the toothed edge of member 22 and the roll of web material 21 is placed in the box, its free end being brought forward over the top of member 22 and then tucked down between that member and roller 18. The door is then closed, leaving a flight of the web positioned in the web path defined below roller 18 and the edge of door 11 and over the upper face of member 22, and the dispenser is then ready for use. The rotation of roll 21 can be in either direction as web material is drawn off; in the case of heavier and less easily flexed materials the web path indicated by the broken line 30 in FIG. 2 is preferred tangential to the bottom periphery of the roll so that the latter rotates anti-clockwise as viewed in FIG. 2. With lighter materials such as plastics film the path indicated by line **30*a* may be preferable so that the web is drawn from the front periphery of the roll to pass around roller 18, roll 21** rotating clockwise.

In either case when web material is required a user will draw the required length forward and slightly upwardly so that it is kept clear of the teeth 25 and will then pull it downwards and sideways, causing member 22 to pivot forward to clamp the web between ridge 26 and roller 18 and at the same time sever it by the action of teeth 25. This action can be carried out with one hand as the automatic clamping action makes it unnecessary to restrain the web or control it manually. As soon as severance is completed the downward pull ceases and the member 22 pivots back to its normal position.

In this way dispensing is particularly convenient and large rolls of material can be used without damage or wastage even in the case of material normally found difficult to handle such as metal foil or plastics "cling" film. The dispenser may be provided in a range of sizes to suit particular roll diameters and lengths.

In the case of rolls of the larger sizes, particularly of heavy material such as metal foil, there may be some risk of damage and unacceptably high friction and tension if the roll periphery rests directly on the floor of the box. In such cases a pair of end caps 31 (shown in FIG. 2) may be used, each cap including a circular disc 32 slightly greater is diameter than the full roll to provide low friction guidance and engagement with the box walls and roller 18, and integrally moulded radially extending flexible limbs 33 extending from a central boss and bowed for gripping engagement in the ends of a central passage or hollow core of roll 21.

Additional guide rollers may be provided, for example a further guide roller could be pivoted across an upper part of the door and/or the roll 21 might rest on pivoted rollers within the box. In another construction the roll itself could be journalled on a drum or spindle within the box or within some other form of supporting framework.

We claim:

1. A dispenser for web material in roll form including:

a. a container within which a roll is adapted to be rotatably supported for selective withdrawl of the web along a path defined by an opening in the container, the front of the container being a hinged door which in a closed position defines said opening as a gap between its lower edge and a floor of the container, and said floor extending forwardly substantially beyond said lower edge;

b. a freely rotatable guide roller carried on rearwardly extending formations of the door adjacent said gap and extending transversely of the upper side of the web path;

c. a severing member pivotally mounted on said forward extension of the floor for rocking movement about a transverse fulcrum axis at the lower side of the web path, said severing member having a forwardly directed tearing edge extending across an outer part of said path remote from said fulcrum axis and a clamping portion inwardly of said fulcrum axis for co-operation with the guide roller to trap and resist outward movement of an inner part of the web in said path as an outer part of the web is pulled downwards at an angle against the tearing edge for severance from the roll; and d. hinge means of the door located on forwardly extending arms on each side of the floor forward extension so that the hinge axis is adjacent the front edge of said extension whereby opening movement of the door carries the guide roller forwards and downwards clear of the tearing edge of the severing member to facilitate positioning of the web in the web path.

2. A dispenser as claimed in claim 1, wherein the severing member is a metal element having at least one downwardly directed depression providing fulcrum means for said element, a front tearing edge, and a ridged rear portion forming the clamping portion.

3. A dispenser as claimed in claim 2, wherein said element is formed with two laterally spaced depressions forming said fulcrum means and said tearing edge is serrated.

4. A dispenser as claimed in claim 1 wherein the container is a box having a curved back and floor to accommodate the periphery of the roll.

5. A dispenser as claimed in claim 4 wherein said floor slopes forward so that the roll will contact said guide roller at the front of the container.

6. A dispenser as claimed in claim 4 wherein the area of said back and floor against which said periphery may abut has a broken surface finish to reduce friction and tendency of thin film to cling.

7. A dispenser as claimed in claim 1 wherein the roll supporting means includes a pair of end caps each including a circular disc which will rest and rotate within the container and a plurality of radially extending flexible limbs for gripping engagement within a central core passage of the roll in use.

* * * * *